US007216961B2

(12) United States Patent
Oikawa et al.

(10) Patent No.: US 7,216,961 B2
(45) Date of Patent: May 15, 2007

(54) INK JET HEAD HAVING HEAT ACCUMULATION LAYER AND PROTECTION FILM METHOD OF DRIVING THEREOF AND INK JET RECORDING APPARATUS PROVIDED THEREWITH

(75) Inventors: Masaki Oikawa, Tokyo (JP); Mineo Kaneko, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 277 days.

(21) Appl. No.: 11/012,186

(22) Filed: Dec. 16, 2004

(65) Prior Publication Data

US 2005/0140732 A1 Jun. 30, 2005

(30) Foreign Application Priority Data

Dec. 26, 2003 (JP) ..... 2003-434520

(51) Int. Cl.
*B41J 2/05* (2006.01)

(52) U.S. Cl. ..... 347/64; 347/56; 347/63

(58) Field of Classification Search ..... 347/20, 347/56–59, 61–65, 67
See application file for complete search history.

(56) References Cited

U.S. PATENT DOCUMENTS 4,567,493 A * 1/1986 Ikeda et al. ..... 347/64
4,723,129 A * 2/1988 Endo et al. ..... 347/56
6,412,920 B1 7/2002 Matsumoto et al. ..... 347/64
6,435,660 B1 8/2002 Ozaki et al. ..... 347/63
6,474,790 B2 11/2002 Kaneko ..... 347/64

FOREIGN PATENT DOCUMENTS

JP 2001-171127 6/2001
JP 2002-011886 1/2002

OTHER PUBLICATIONS

*Counterpart U.S. patent also cited (see text of IDS).
Patent Abstracts of Japan, vol. 1997, No. 11, Nov. 28, 1997 (JP 9-187936, Jul. 22, 1997).
Patent Abstracts of Japan, vol. 2000, No. 23, Feb. 10, 2001 (JP 2001-171127, Jun. 26, 2001).
Patent Abstracts of Japan, vol. 2002, No. 05, May 3, 2002 (JP 2002-011886, Jan. 15, 2002).

* cited by examiner

*Primary Examiner*—Juanita D. Stephens
(74) *Attorney, Agent, or Firm*—Fitzpatrick, Cella, Harper & Scinto

(57) ABSTRACT

A base member for an ink jet head in which a heat accumulation layer, a heat generating member generating heat energy used to discharge ink, and protection film for protecting the heat generating member are formed in succession on a substrate, characterized in that the heat resistance value of a portion of the heat accumulation layer which is under the heat generating member is two times or greater and less than five times as great as the heat resistance value of a portion of the protection film which is on the heat generating member.

6 Claims, 10 Drawing Sheets

INK JET HEAD HAVING HEAT ACCUMULATION LAYER AND PROTECTION FILM METHOD OF DRIVING THEREOF AND INK JET RECORDING APPARATUS PROVIDED THEREWITH

BACKGROUND OF THE INVENTION

1. Field of the Invention

This invention relates to a method of driving an ink jet head for discharging ink in accordance with an ink jet process and effecting recording on a recording medium, an ink jet head and an ink jet recording apparatus, and particularly to what utilizes heat energy to discharge ink.

"Recording" in the present invention means not only imparting images having meanings such as characters and figures, but also imparting images having no meaning such as patterns.

2. Related Background Art

In recent years, numerous recording apparatuses have come to be used as apparatuses such as a printer for effecting recording on recording mediums such as paper, yarn, fiber, cloth, metals, plastics, glass, wood and ceramics, a copying machine, a facsimile apparatus having a communication system, and a word processor having a printer portion, and further a recording apparatus compoundly combined with various processing apparatuses. High-speed recording, high resolution, a high quality of image, low noise, etc. are required of these recording apparatuses. An ink jet recording apparatus may be mentioned as a recording apparatus meeting such requirements. The ink jet recording apparatus uses an ink jet head having a discharge port, discharges ink (recording liquid) droplets from the discharge port and makes them adhere to a recording medium to thereby effect recording. In the ink jet recording apparatus, the ink jet head and the recording medium are in non-contact with each other and therefore, very stable recorded images or the like can be obtained.

Among such ink jet heads, an ink jet head utilizing heat energy to discharge ink has the advantages that a number of discharge ports can be arranged highly densely and therefore recording of high resolution can be effected, and that it is easy to make the head compact.

In the conventional ink jet head utilizing heat energy, a plurality of heat generating resistance members are arranged in the form of a row on a base member of silicon or the like to thereby achieve high density, and a construction having a common heat accumulation layer and electrical insulating film to the plurality of heat generating resistance members is popular (Japanese Patent Application Laid-open No. 2001-171127 and Japanese Patent Application Laid-open No. 2002-011886).

FIG. 14 of the accompanying drawings shows a typical cross-sectional view of the conventional ink jet head utilizing heat energy in the portion of a heat generating resistance member thereof.

As shown in FIG. 14, the ink jet head 100 has a base member 120 formed with a heat generating resistance member (heater) 123, and a nozzle material 110 joined onto the base member 120. The base member 120 has, on the surface of a substrate 121 formed of silicon, a heat accumulation layer 122 constituted by a plurality of layers such as thermally oxidated film, a heat generating resistance member 123 partly formed on the heat accumulation layer 122, electrode wires 124, 125 for supplying electric power to the heat generating resistance member 123, electrical insulating film 126 formed so as to cover the heat generating resistance member 123 and the heat accumulation layer 122, and anti-cavitation film 127 consisting of Ta and formed on the electrical insulating film 126. The electrical insulating film 126 and the anti-cavitation film 127 together constitute protection film 128. The nozzle material 110 is joined to the base 120 to thereby form a liquid path having an ink chamber 112 above the heat generating resistance member 123. Also, the nozzle material 110 has a discharge port 111 formed at a location opposed to the heat generating resistance member 123.

The ink chamber 112 is filled with ink and in this state, a voltage is applied to the heat generating resistance member 123 through the electrode wires 124 and 125, whereby the heat generating resistance member 123 generates heat. By the heat generation of the heat generating resistance member 123, the ink in the ink chamber 112 is suddenly heated and film-boils. Thereby, a bubble is produced in the ink, and by pressure based on the growth of the bubble, the ink is discharged from the discharge port 111.

In order to efficiently transmit the heat energy generated by the heat generating resistance member 123 to the ink, various contrivances have heretofore been proposed about the film construction of the base member 120.

Reference is now made to FIG. 15 of the accompanying drawings to describe the principle of heat transmission by the heat generation of the heat generating resistance member 123. In FIG. 15, the heat generating resistance member 123 is electrically energized, whereby a quantity of heat Q is applied. The quantity of heat Q is diffused to above and below the heat generating resistance member 123 and becomes Q1 and Q2. The quantity of heat Q1 diffused to above is transmitted to the ink 130 on the protection film 128. Thereby, a bubble 131 is produced in the ink 130, and discharge is effected as described above.

SUMMARY OF THE INVENTION

The present invention has as its object to provide a base member for ink jet head having a heat accumulation layer, a heat generating member generating heat energy used to discharge ink, and protection, film for protecting the heat generating member successively formed on a substrate, characterized in that the heat resistance value of a portion of the heat accumulation layer which underlies the heat generating member is two times or greater and less than five times as great as the heat resistance value of a portion of the protection film which overlies the heat generating member, to thereby effectively prevent the deterioration of the protection film without reducing heat transmission efficiency to the ink and realize the longer life of the heat generating resistance member, and improve a radiation characteristic and realize driving at a higher frequency.

DESCRIPTION OF THE PREFERRED EMBODIMENTS

Figure 1:
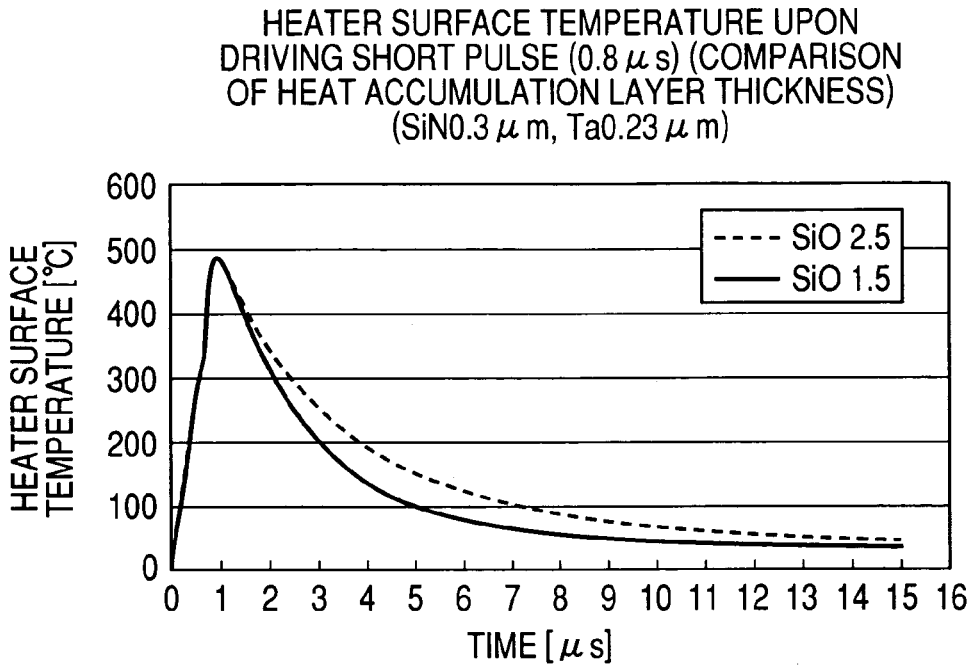
FIG. 1 is a graph by simulation illustrating the epitome of the present invention and showing the relation of a variation in the surface temperature of a heat generating resistance member with the lapse of time from the point of time of the application of a driving pulse when the heat generating resistance member has been driven at 0.8 μs.

Regarding a layer on a heat generating resistance member, protection film is formed as film relatively low in heat conductivity and having a small thickness so that heat may be uniformly transmitted to ink. The protection film serves also as insulation with the ink.

On the other hand, the thickness of a layer under the heat generating resistance member is determined by a manufacturing method, the durability of the heat generating resistance member, etc. Also, from the viewpoint of the heightening of a recording speed, a contrivance for shortening the driving electrical energization time (pulse width) of the heat generating resistance member has been made. For example, if the driving frequency is 30 kHz and the driving is 16-division driving, the heat generating resistance member must be driven for about 2 μs or less. Taking a margin in driving into account, still a shorter pulse is preferable. The driving electrical energization time is shortened and a heat flux is increased, whereby stabler bubbling is obtained, and stable bubbling is most effective in a discharging method of communicating a bubble with the atmosphere, and in an ink jet head for high-quality recording, it is a requisite factor that the driving electrical energization time is about 0.5–1.2 μs. Further, a driving pulse is divided into a plurality of pulses, i.e., double pass or triple pass, whereby discharge efficiency can be further improved.

The heightening of the recording speed has been advanced and along therewith, the ink jet head (heat generating resistance member) has come to be driven at a higher frequency. Thus, it sometimes happens that before the quantity of heat remaining after the bubbling of the ink has ended is sufficiently radiated, the bubbling of the ink is repeated and a base member accumulates heat therein. As a result, a phenomenon called re-boiling occurs and a discharging characteristic is remarkably reduced, and mechanical destruction by cavitation during debubbling is expedited, and this has been the cause of a remarkable reduction in the durability of the heat generating resistance member.

In the method of communicating a bubble with the atmosphere, cavitation can be avoided, but when supplied energy becomes small due to voltage drop or the like, cavitation becomes more remarkable. So, energy is excessively supplied in some cases, but in such cases, the thermochemical reaction of the ink on the protection film is expedited, whereby the so-called "kogation (scorching)" in which the composition of the ink is carbonized and adheres to the protection film occurs, and the discharging characteristic may be reduced. Further, the protection film itself also has its oxidation expedited and is reduced in strength, and this has become the cause of a remarkable reduction in the durability of the heat generating resistance member.

Also, the high-quality recording by a recording apparatus has been advanced and the size of a discharged droplet has become smaller day by day and at present, it is an infinitesimal size of several pl. Therefore, as compared with the prior art, it is necessary to increase a discharge amount relative to the supplied energy, i.e., discharge efficiency by several times to about ten times, and this has been a difficult problem.

To avoid this problem, there is a method of increasing the number of the heat generating resistance members. However, any increase in the number of the heat generating resistance members leads to a requirement for a considerable number of driving circuits, memories, etc. therefor, and not only the size of the base becomes large, but also driving becomes cumbersome, and the higher integration of the driving IC of a recording apparatus main body and the complication of software or the like will result in an increase in cost.

The present invention has been made in view of the above-noted problem, and an embodiment of the present invention will hereinafter be described with reference to the drawings.

"(Numerical value A)–(Numerical value B)" herein indicates the range of "equal to or greater than numerical value A and equal to or less than numerical value B". Also, the heat generating member or the heat generating resistance member refers to not a whole layer formed on a heat accumulation layer, but a portion thereof which is a portion of an area for causing heat generated by electrical energization to act on the ink, that is, a portion which, in the absence of the protection film, directly contacts with the ink and heats the ink.

<Epitome of the Ink Jet Head of the Present Invention (Studies by the Inventors)>

Figure 14:
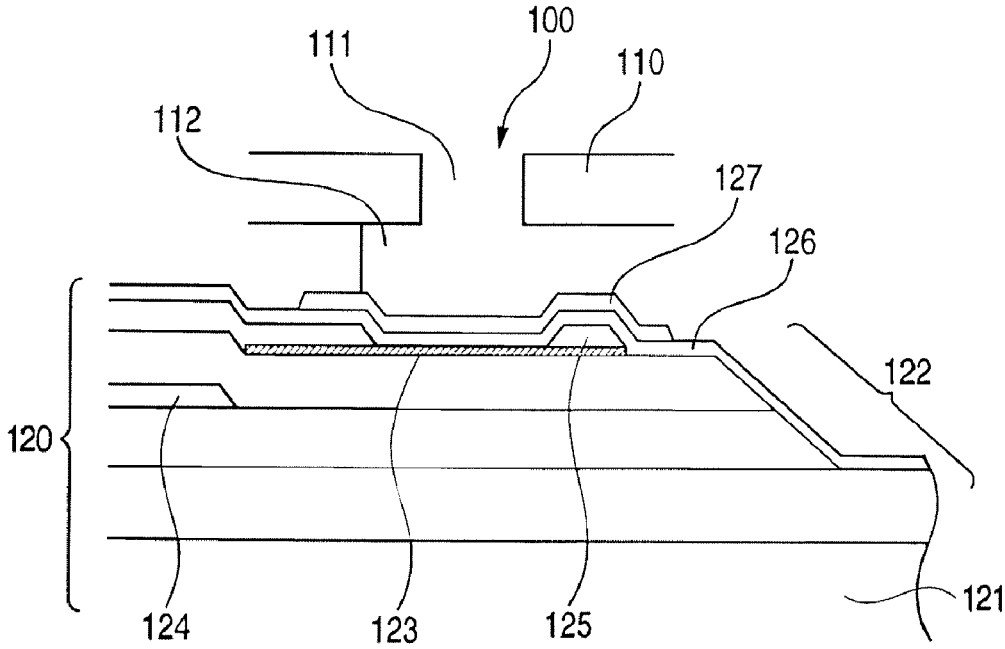
FIG. 14 PRIOR ART
FIG. 14 is a typical cross-sectional view of a conventional ink jet head in the portion of a heat generating resistor thereof.
Figure 15:
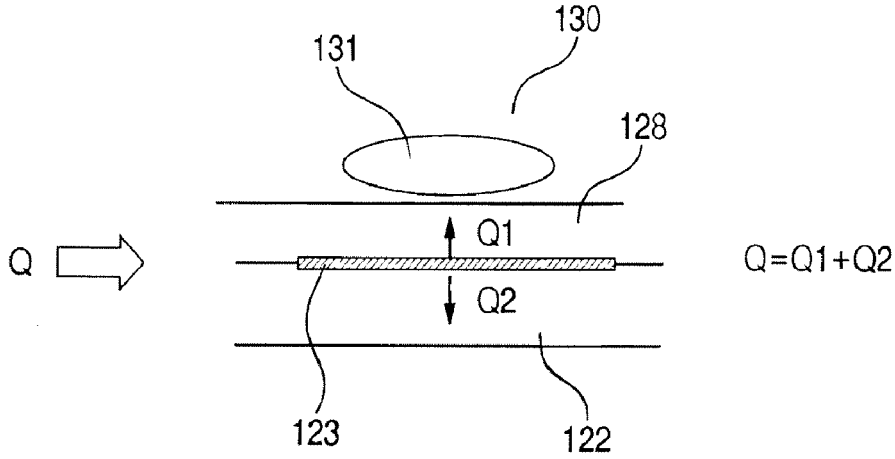
FIG. 15 PRIOR ART
FIG. 15 is a typical view illustrating the principle of heat transmission in an ink jet head.

The epitome of the present invention will first be described. The gist of the present invention resides in making the film constructions on and under a heat generating resistance member into constructions having proper heat resistance. First, in an ink jet head having the film construction as shown in FIG. 14, in order to solve such problems as "scorching" and the deterioration of the protection film by thermochemical reaction, the inventors have calculated, by the use of three-dimensional heat conduction simulation, a variation with the lapse of time in the surface temperature of the heat generating resistance member from the point of time of driving pulse application when the heat generating resistance member has been driven with a driving pulse width of 0.8 μs, with respect to a case where the heat accumulation layer is $SiO_2$ film having a film thickness of 2.5 μm, and a case where the heat accumulation layer is $SiO_2$ film having a film thickness of 1.5 μm, under a condition that the protection film is SiN film (insulating film) having a film thickness of 0.3 μm and Ta film (anti-cavitation film) having a film thickness of 0.23 μm. The result of the calculation is shown in FIG. 1.

As is apparent from FIG. 1, comparing the two kinds of heat accumulation layers, the maximum peak temperatures are of the order of 500° C. in both, namely, substantially the same, but the temperature thereafter lowers more rapidly in the layer having a smaller film thickness. From this result, it is considered that by making the thickness of the heat accumulation layer small, the radiation characteristic can be improved without the heat transmission efficiency to the ink being reduced.

So, several ink jet heads in which the protection film is constituted by SiN film (insulating film) having a film thickness of 0.3 μm and Ta film (anti-cavitation film) having a film thickness of 0.23 μm, and the thickness of the heat accumulation layer differs have been made on an experimental basis, and the durability thereof, i.e., the driving pulse number until the ink comes to be not normally discharged, has been evaluated.

Figure 2:
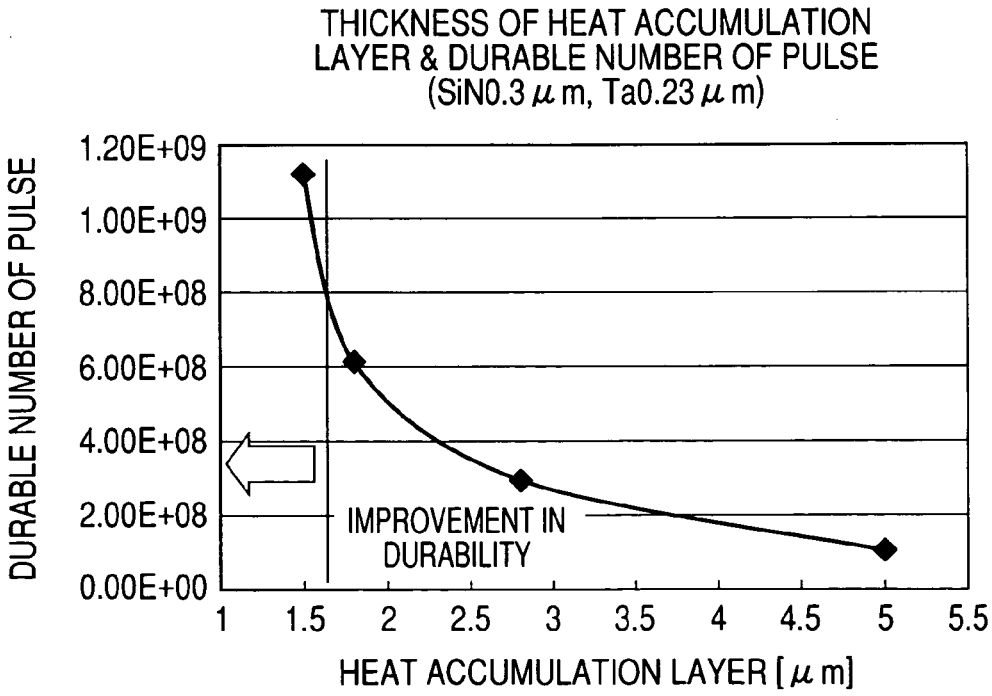
FIG. 2 is a graph illustrating the epitome of the present invention and showing the relation between the thickness of a heat accumulation layer by a head made on an experimental basis and the durable number of pulses.

The result of the evaluation is shown in FIG. 2 as the relation between the thickness of the heat accumulation layer and the durable number of pulses. From FIG. 2, it has been newly found that when the film thickness of the heat accumulation layer is 1.7 μm or less, the durability is greatly improved. That is, the smaller is made the thickness of the heat generation layer, the more is improved the durability.

Next, the inventors have calculated, by the use of three-dimensional heat conduction simulation, how thin the heat accumulation layer can be made without the heat transmission efficiency to the ink being reduced. The result is shown in FIG. 3.

Figure 3:
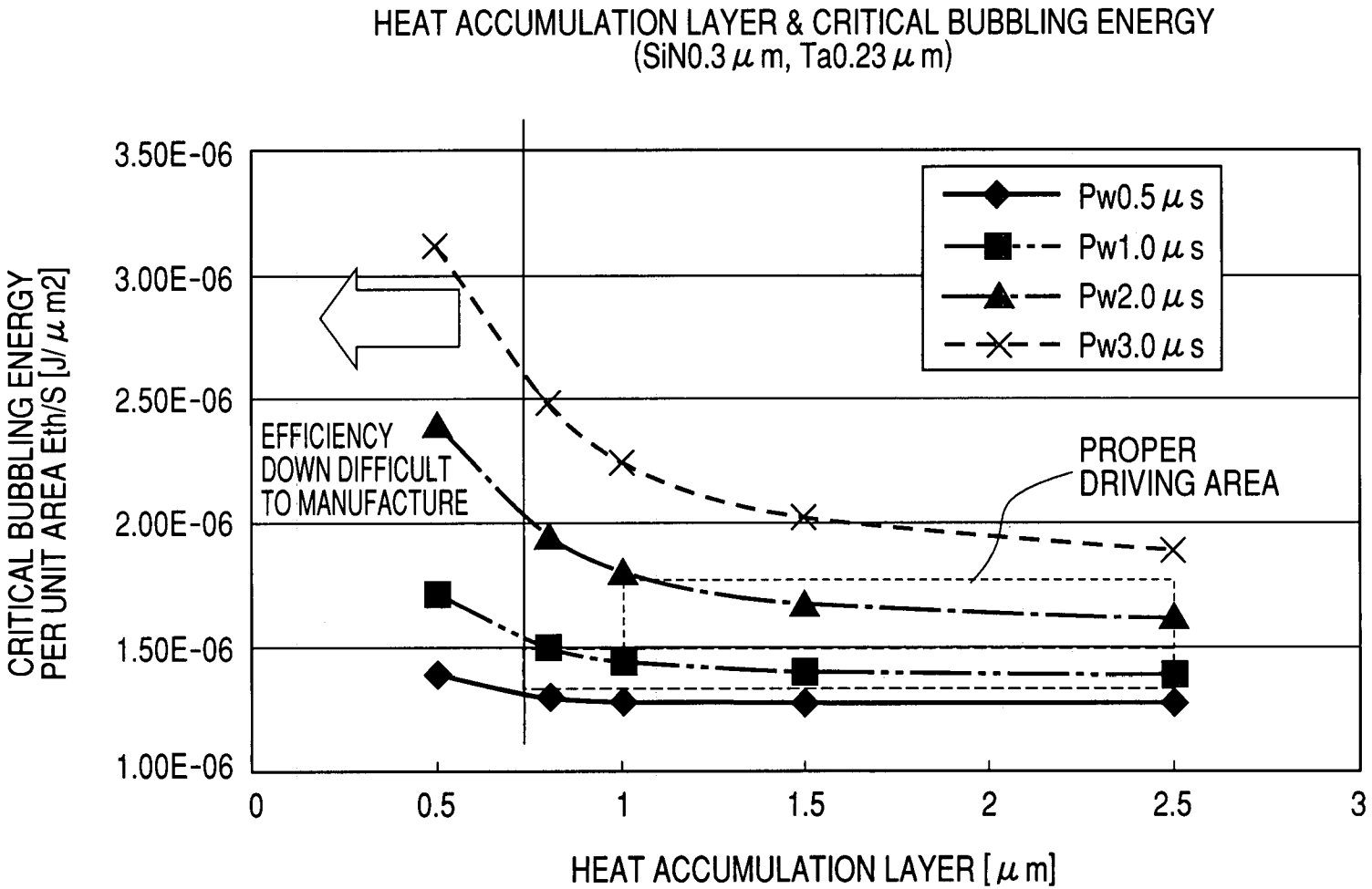
FIG. 3 is a graph illustrating the epitome of the present invention and showing the relation between the thickness of the heat accumulation layer by simulation and the ink critical bubbling energy per unit area of the heat generating resistance member.

FIG. 3 is a graph showing the relation between the thickness of the heat accumulation layer and the ink critical bubbling energy per unit area of the heat generating resistance member which has been obtained by the above-mentioned simulation. The ink critical bubbling energy per unit area of the heat generating resistance member becomes the index of the heat transmission efficiency to the ink. The ink critical bubbling energy is a critical heat energy value for the surface temperature of the heat generating resistance member to exceed 300° C. which is the bubbling temperature of the ink, and the greater is this value, the worse is the heat transmission efficiency. The calculation has been carried out with heat energy application time (Pw) which is a driving electrical energization time changed to 0.5 μs to 3.0 μs. This heat energy application time is a proper time obtained as a condition that from the viewpoint of the recording speed of the ink jet head, it is necessary to drive the head at a high speed and the heat energy application time is not too short from driving pulse accuracy. Also, this time includes the proper condition of a high heat flux for effecting stable discharge in the discharging method of communicating a bubble with the atmosphere, i.e., the aforedescribed driving electrical energization time of 0.5 to 1.2 μs.

As is apparent from FIG. 3, when the thickness of the heat accumulation layer is smaller than about 0.7 μs, the heat transmission efficiency to the ink suddenly becomes worse. From this, it will be seen that the thickness of the heat accumulation layer should preferably be 0.7 μm or greater. Also, a heat accumulation layer thinner than 0.7 μm is difficult to form stably.

From FIG. 3, it will further be seen that the heat transmission efficiency becomes worse as the heat energy application time (Pw) becomes longer, and that the longer is Pw, the greater is the influence of the thickness of the heat accumulation layer. Specifically, it will be seen that for Pw of 1.2 to 2 μs, the thickness of the heat accumulation layer may be 1.0 to 1.7 μm without the efficiency being reduced, and for Pw of 0.5 to 1.2 μs which is the proper condition of a high heat flux, the thickness of the heat accumulation layer may be 0.7 to 1.5 μm without the efficiency being reduced, and these ranges are proper.

From what has been described above, it can be said that in a case where the protection film is constituted by SiN film having a film thickness of 0.3 μm and Ta film having a film thickness of 0.23 μm, to make the radiation characteristic good without reducing the efficiency in order to improve durability, 0.7 to 1.7 μm is most proper as the thickness of a heat accumulation layer formed of $SiO_2$, and further, for Pw of 0.5 to 1.2 μs, 0.7 to 1.5 μm is proper as the thickness of the heat accumulation layer, and 1.0 μm or less is more proper. The driving electrical energization is not limited to the case of a single pulse, but may be pulse driving divided into a plurality, and in this case, the total electrical energization time of the respective pulses corresponds to Pw. The relation shown in FIG. 3 shows that a result coinciding with the simulation has also been obtained in the aforedescribed heads made on an experimental basis.

Herein, the materials and thicknesses of the protection film and the heat accumulation layer have been specifically shown, but the present invention is not restricted thereto. The present invention efficiently transmits the applied heat energy to the ink, and properly radiates heat to the heat accumulation layer and therefore, the above-described condition can be substituted for by the heat resistance ratio of the protection film and the heat accumulation layer.

Figure 4:
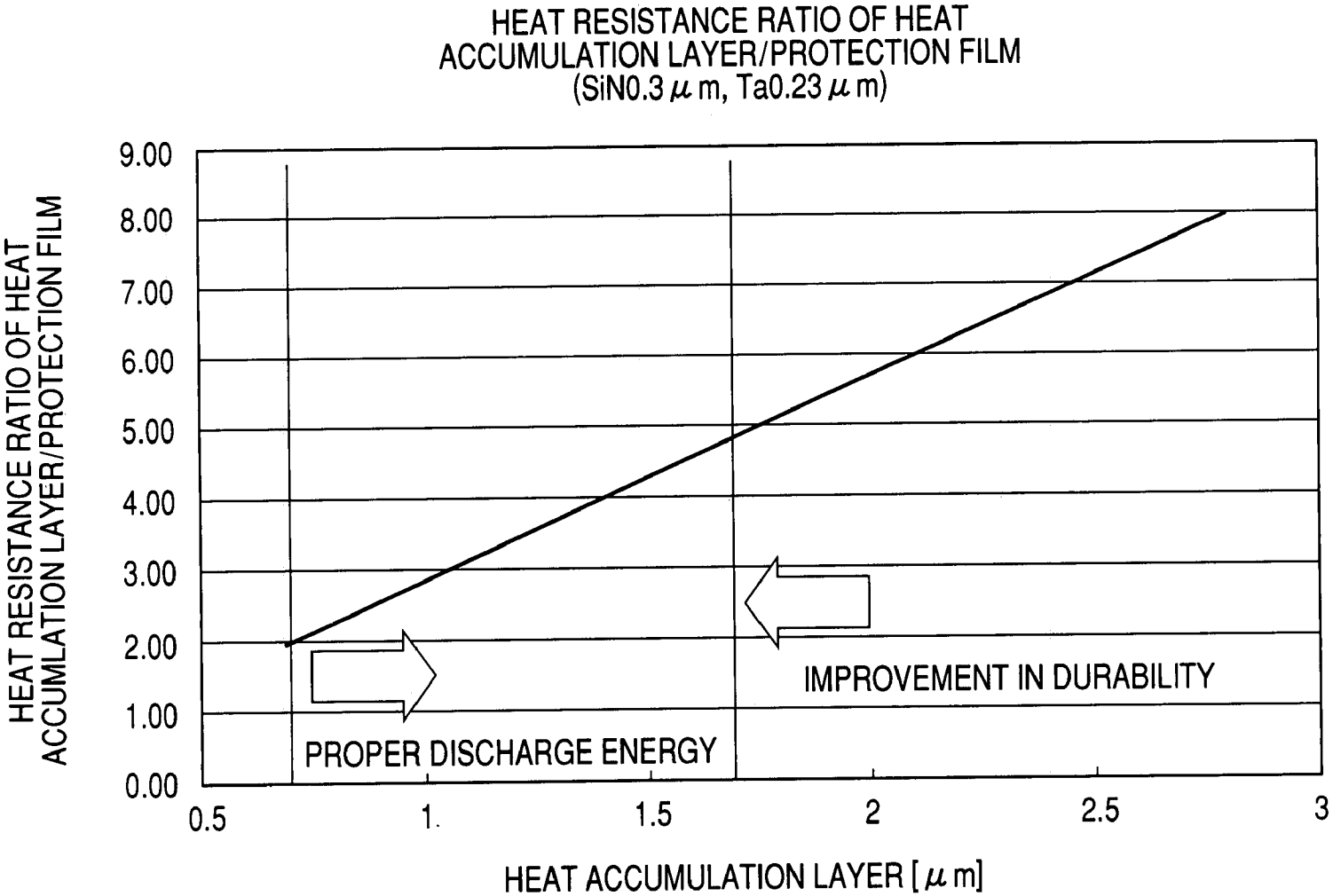
FIG. 4 is a graph illustrating the epitome of the present invention and showing the relation between the thickness of the heat accumulation layer and the heat resistance ratio of the heat accumulation layer/protection film.

The result of the substitution is shown in FIG. 4. FIG. 4 is a graph showing the relation between the thickness of the heat accumulation layer and the heat resistance ratio of the heat accumulation layer/the protection film in which the condition of the heat accumulation layer in the aforedescribed condition of the protection film has been substituted for by the heat resistance ratio of the heat accumulation layer and the protection film. The heat conductivity of each film at this time has been 1.2 w/m·K (according to the result of the measurement of the articles made on an experimental basis) for thin film SiN, 54 w/m·K for thin film Ta, and 1.38 w/m·K for thin film $SiO_2$. As the heat conductivity of the thin film Ta and the thin film $SiO_2$, use has been made of a value generally obtained by literature or the like. The heat resistance value Rs of the thin film, when the heat conductivity of a material forming the thin film is defined as K and the film thickness thereof is defined as d, is given by Rs=d/K. Also, the heat resistance value of the laminated film is a result obtained by adding the heat resistance value of each film to one another.

As is apparent from FIG. 4, the film thickness condition of the heat accumulation layer, i.e., 0.7 μm or greater and 1.7 μm or less, in the protection film comprising SiN film having a film thickness of 0.3 μn and Ta film having a film thickness of 0.23 μm can be substituted for by a range of two times or greater and less than five times in terms of the heat resistance ratio of the heat accumulation layer/the protection film. From this, it will be seen that the range of two times or greater and less than five times is proper as the ratio of the heat resistance of the heat accumulation layer under the heat generating resistance member to the heat resistance of the protection film on the heat generating resistance member.

Further consideration will hereinafter be made of what influence such incomings and outcomings of heat have upon durability. Great factors having influence upon durability are "scorching" and breakage. "Scorching" is the phenomenon that the decomposed material or the like of a dye contained in the ink adheres to a heat generating portion which is a portion of the protection film on the heat generating resistance member to thereby act to hamper uniform bubbling or weaken bubbling energy, and it is known that the adhering amount of "scorching" is greater as the surface temperature of the heat generating portion becomes higher. On the other hand, breakage has the factors of chemical action and mechanical action. As previously described, the protection film including the insulating film and the anti-cavitation film is formed on the upper layer of the heat generating resistance member, but inorganic film of SiN or the like used as the insulating film is inferior in ink resistance and mechanical resisting characteristic, and if a defect occurs to the anti-cavitation film, the ink enters therefrom to thereby corrode the heat generating resistance member and bring it to breakage. Accordingly, the life of the anti-cavitation film greatly affects durability. Taking tantalum typical as the anti-cavitation film as an example, it is observed that an oxide (oxidated layer) is formed on the surface of the. anti-cavitation film subjected to an endurance test. The degree of oxidation can be known by such means as the discoloration of the surface of tantalum, the surface composition analysis by an electron probe micro analyzer (EPMA) or the like, or the observation of the cross-section of the film by a focused ion beam working observation apparatus (FIB). The oxidated layer is inferior in chemical and mechanical strength, and is exfoliated by the shock of cavitation. The anti-cavitation film has its damage enlarged while the oxidation and exfoliation are repeated and finally, the damage reaches the insulating layer. Also, in such a construction communicating a bubble with the atmosphere so that cavitation may not occur, durability is improved, but finally breakage results. This is because the component in the ink chemically erodes the oxidated layer, and when the film thickness after the endurance test is measured by the FIB or the like, it is observed that the film thickness has become smaller in conformity with the number of pulses. Also, the higher is temperature, the more liable to be eroded becomes the oxidated layer. Thus, it will be understood that the quicker is the oxidation of the anti-cavitation film, the shorter becomes its endurance life.

Thus, the breakage of the heat generating resistance is caused by the oxidation of the anti-cavitation film in both of the mechanical factor and the chemical factor, and it is effective in improving durability to suppress this oxidating action. The oxidation of the anti-cavitation film occurs due to the ink being present on the anti-cavitation film under high heat, but the component of the ink is determined from the solvability of the dye and the fixing property to a printing medium and is low in the degree of freedom of selection and therefore, it is realistically effective as a measure for preventing oxidation to lower the surface temperature of the protection film. To lower the surface temperature of the protection film, there are the means of (1) lowering the highest reaching temperature, and (2) quickening the cooling.

Also, to lower the highest reaching temperature, there are two methods of (1a) uniformizing the surface temperature, and (1b) reducing the supplied energy.

To uniformize the surface temperature, it is necessary to prevent heat from escaping toward the inside of the surface of the film, and it is important to make the film thickness of the protection film as small as possible and heighten heat resistance in the direction toward the inside of the surface, and quickly heat the protection film within a short time to thereby give sufficient heat to the ink before the heat is transmitted toward the inside of the surface of the protection film, thereby causing the ink to bubble. Regarding the supplied energy, it is usual to provide a value resulting from a bubbling threshold value voltage being multiplied by a certain coefficient with the unevenness of the characteristics of individual heat generating resistance members and the fluctuation of a power source voltage taken into account, but the highest reaching temperature rises depending on this coefficient and oxidation also becomes behement and therefore, it is desirable to set the supplied energy as low as possible. It is desirable to keep a driving voltage between 1.1 to 1.2 times relative to the bubbling threshold value voltage, and if the driving voltage exceeds 1.3 times (the square thereof in terms of energy conversion), oxidation progresses suddenly, and this is not preferable. The aforedescribed heating within a short time is liable to cause uniform film boiling and therefore is little in unevenness, and is effective also in suppressing the supplied energy.

On the other hand, to heighten the cooling speed, it is necessary to expedite heat transmission to the periphery, but improving the heat transmission of the insulating film and the anti-cavitation film raises the highest reaching temperature for the above-described reason, and this is not preferable. Accordingly, it is preferable to improve the heat transmission to the silicon substrate through the heat accumulation layer. To improve the heat transmission to the silicon substrate, it is good to make the thickness of the heat accumulation layer as small as possible, but if this thickness is made too small, the heat escapes to the silicon substrate before the start of film boiling in the course of the heating of the ink and therefore, further energy becomes necessary in order to cause film boiling. Any excess energy is stored in the silicon substrate, and this is against the suppression of the surface temperature and is not preferable. Accordingly, as previously described, the film thicknesses and materials of the protection film and the heat accumulation layer are set so that the heat resistance value of the heat accumulation layer under the heat generating resistance member may be within the range of two times or greater and less than five times as great as the heat resistance value of the protection film on the heat generating resistance member, whereby it becomes possible to effectively prevent the deterioration of the protection film without reducing the heat transmission efficiency to the ink and improve the durability of the heat generating resistance member, and also improve the radiation characteristic, and driving for a very short driving electrical energization time of 0.5 to 2.0 μs, i.e., at a high frequency becomes possible. By adopting the above-described construction, the cooling of the protection film is quick and therefore the surface temperature of the protection film is lowered during the occurrence of cavitation during the disappearance of the bubble after the discharge of the ink, or when the bubble communicates with the atmosphere, and as compared with the prior art, it also becomes possible to prevent the oxidation of the protection film.

Figure 5:
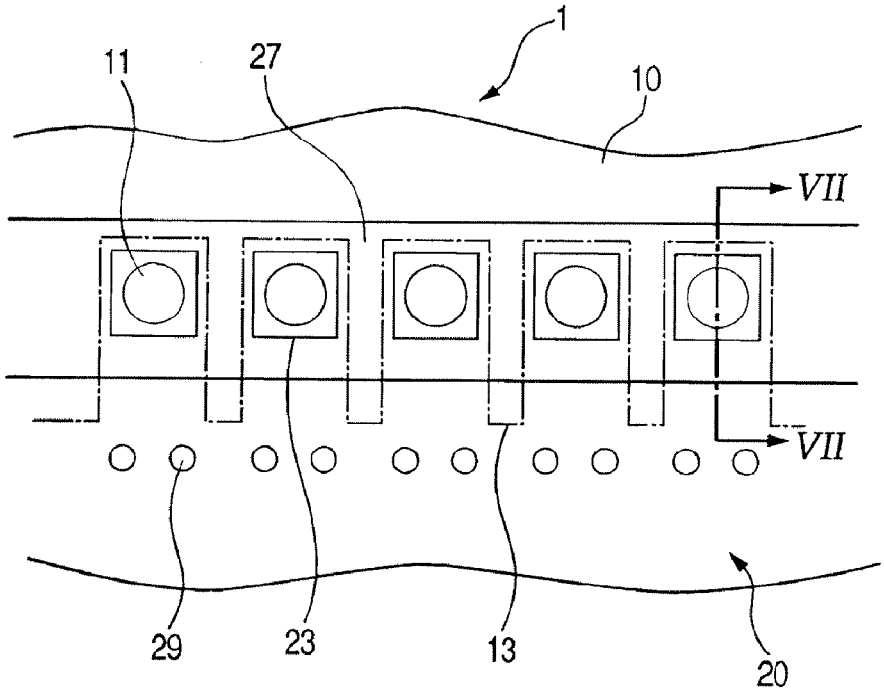
FIG. 5 is a plan view of the essential portion of construction example 1 of an ink jet head suitably used in the present invention as it is seen from a discharge port side.

In the prior art as well, it has been proposed to lower the surface temperature to improve durability. In the prior art, however, it is a main purpose to prevent cavitation destruction due to the re-boiling of the ink. The cavitation destruction due to the re-boiling of the ink is a phenomenon which occurs in a case where the surface temperature of the protection film is 100° C. or higher when the ink contacts with the surface of the protection film. In the present invention, attention is paid to the oxidation of the surface of the protection film, and this phenomenon occurs also at 100° C. or lower, irrespective of the re-boiling of the ink. Further, in an ink jet head of a side shooter type shown in FIG. 14 and FIG. 5 which will be described later, it has been found that there is a case where breakage occurs substantially centrally of a heat generating portion. This is considered to be due to the fact that when after bubbling, the ink flows onto the heat generating portion, the inflow of the ink takes place preferentially from an ink chamber into which a supply port opens and from a discharge port opposed to the heat generating portion because as seen in FIG. 5, the three sides of the heat generating portion are surrounded by a nozzle wall, and therefore the ink having flowed in from the vicinity of the discharge port contacts with the center of the heat generating portion at first. The center of the heat generating portion, as previously described, has the tendency that the highest reaching temperature becomes high and moreover, the peripheral portion thereof first cools during cooling and therefore, the center tends to be at a high temperature to the last. When the ink contacts with this portion, not only oxidation progresses, but also mechanical destruction due to the temperature difference from the surroundings is also accelerated, and this is not preferable. Therefore, more uniform heating and quick cooling are required. In an edge shooter type (in which the discharge direction is a direction parallel to the heat generating surface), such breakage of the center of the heat generating portion did not occur. This is considered to be because the inflow direction of the ink is parallel to the surface of the heat generating portion and the ink flows in from a side on which the temperature around the heat generating portion is low.

Thus, temperature is an important factor in both of "scorching" and breakage which greatly affect the durability of the ink jet head, and it will be understood that to improve the durability, it is effective to satisfy the above-described relation between the protection film and the heat accumulation layer.

<Ink Jet Recording Apparatus>

Figure 12:
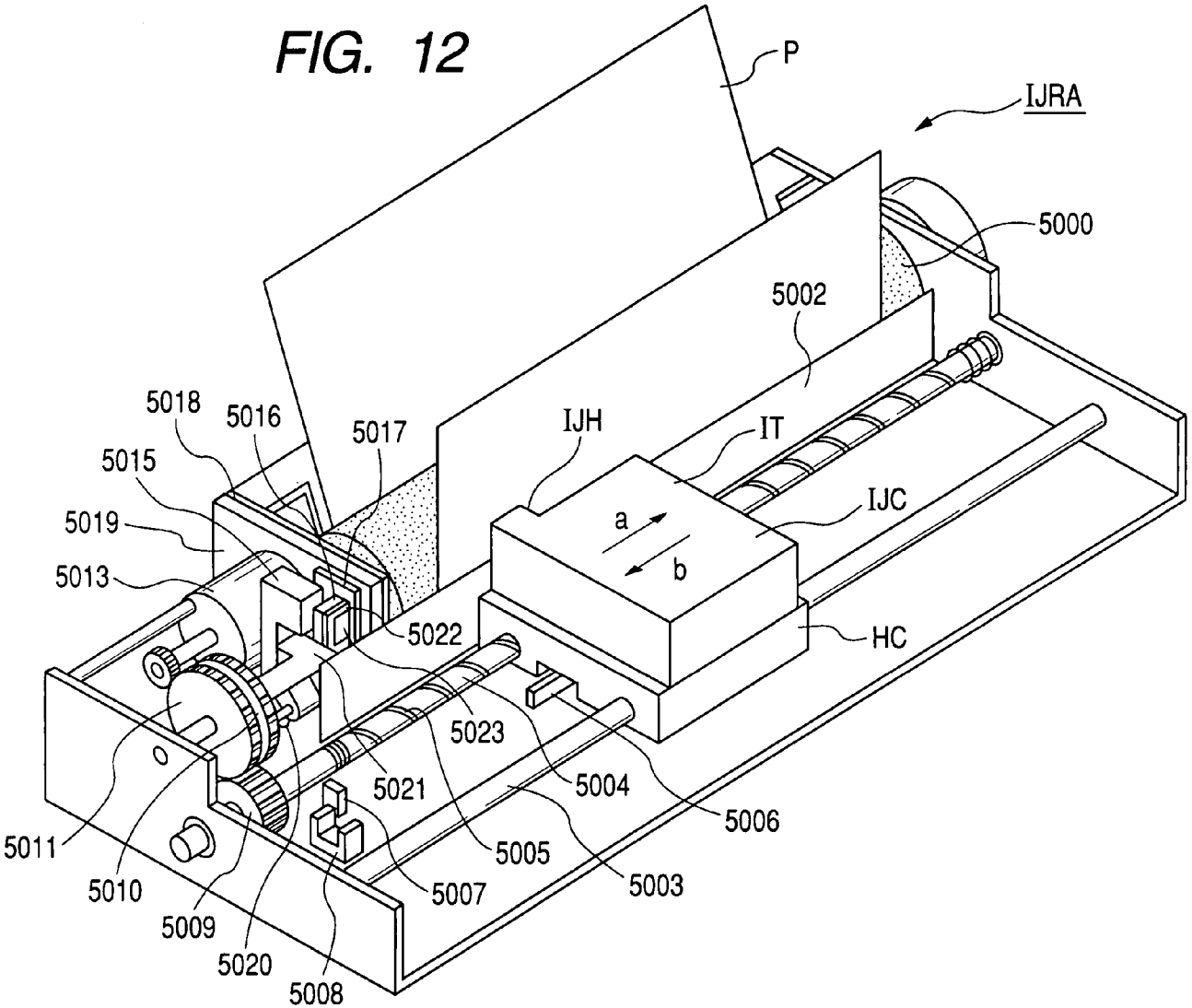
FIG. 12 is a typical perspective view showing an example of the ink jet recording apparatus of the present invention.

Reference is now had to FIG. 12 to describe an ink jet recording apparatus on which the ink jet head of the present invention is mounted.

FIG. 12 is a typical perspective view showing an example of the ink jet recording apparatus of the present invention. In FIG. 12, a lead screw 5004 formed with a spiral groove 5005 is rotatably journalled to a main body frame. The lead screw 5004 is rotatively driven through driving force transmitting gears 5009–5011 in operative association with the forward and reverse rotation of a drive motor 5013.

Further, a guide rail 5003 for slidably guiding a carriage HC is fixed to the main body frame. The carriage HC is provided with a pin (not shown) engaged with the spiral groove 5005, and the lead screw 5004 is rotated by the rotation of the drive motor 5013, whereby the carriage HC can be reciprocally moved in the directions of arrows a and b. A paper pressing plate 5002 presses a recording medium P against a platen roller 5000 over the direction of movement of the carriage HC.

An ink jet recording unit IJC is mounted on the carriage HC. The ink jet recording unit IJC may take the form of a cartridge in which the above-described ink jet head is made integral with an ink tank IT, or a form in which they are detachably combined with each other as discrete members. Also, this ink jet recording unit IJC is fixedly supported on the carriage HC by positioning means and an electrical contact provided on the carriage HC, and is provided so as to be detachably mountable with respect to the carriage HC.

Photocouplers 5007 and 5008 together constitute home position detecting means for confirming the presence of the lever 5006 of the carriage HC in this region and effecting the reversal or the like of the direction of rotation of the drive motor 5013. A cap member 5022 for capping the front surface (the surface in which the discharge port opens) of the ink jet head is supported by a supporting member 5016, and further is provided with suction means 5015, and effects the suction recovery of the ink jet head through an opening 5023 in the cap. A supporting plate 5019 is mounted on a main body supporting plate 5018, and a cleaning blade 5017 slidably supported on this supporting plate 5018 is moved back and forth by driving means, not shown. The form of the cleaning blade 5017 is not restricted to what is shown, but of course, a known one can be applied. A lever 5021 is for starting the suction recovering operation of the ink jet head, and is moved with the movement of a cam 5020 which abuts against the carriage HC, and the movement thereof is controlled by a driving force from the motor 5013 being transmitted by the gear 5010 or conventional transmitting means such as latch changeover.

The processes of capping, cleaning and suction recovery are adapted to be carried out at respective corresponding positions by the action of the lead screw 5004 when the carriage HC has been moved to a home position side area, but if design is made such that a desired operation is performed at well-known timing, any of them can be applied to the present example.

Figure 13:
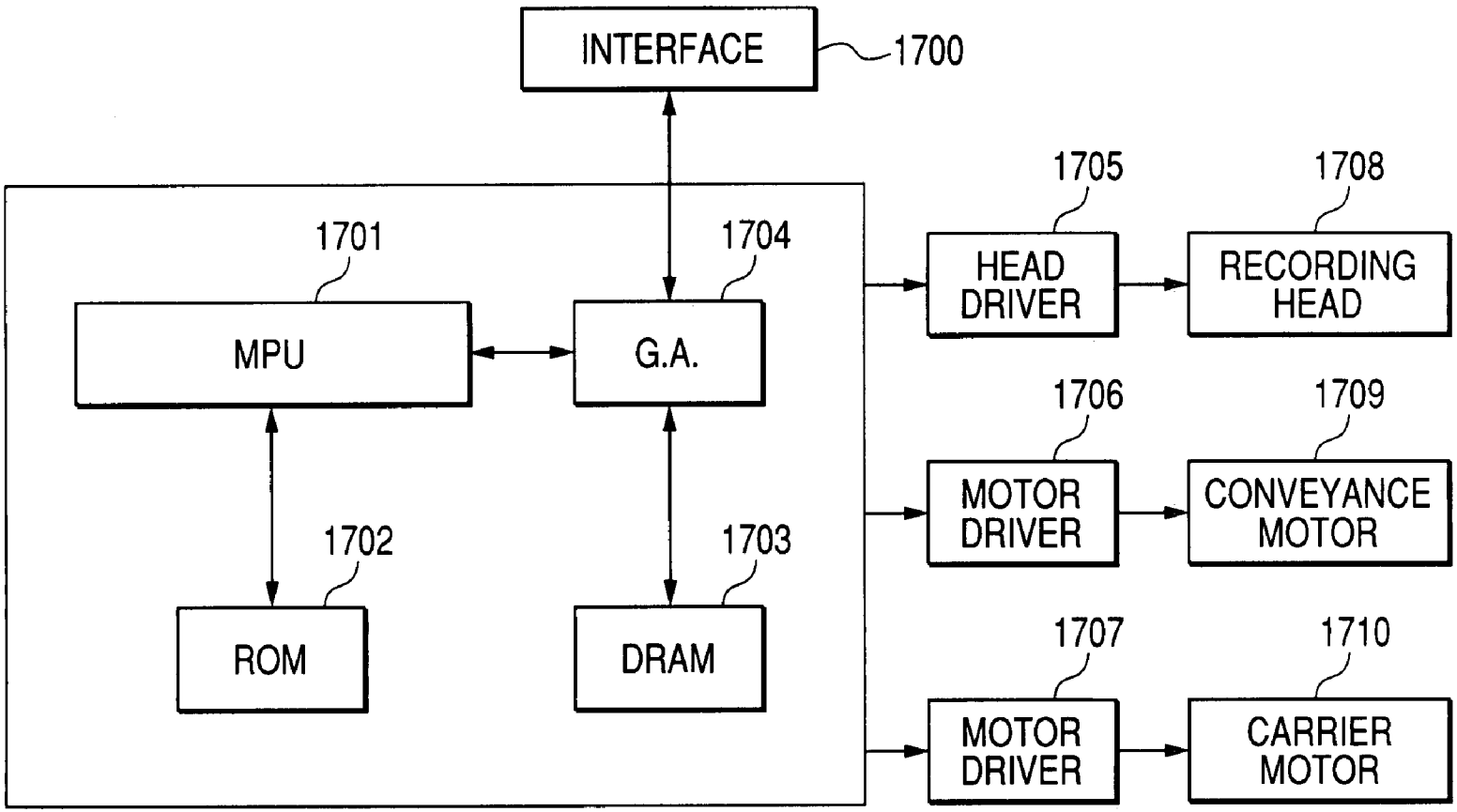
FIG. 13 is a block diagram of an example of a control circuit for controlling the operation of the ink jet recording apparatus shown in FIG. 12.

FIG. 13 shows a block diagram of a control circuit for controlling the operation of the above-described ink jet recording apparatus. The control circuit shown in FIG. 13 has an interface 1700 to which a recording signal is inputted from an external device such as a computer, a controlling portion for governing the operation of the ink jet recording apparatus on the basis of the recording signal inputted through the interface 1700, a head driver 1705 for driving a recording head (ink jet head) 1708, a motor driver 1706 for driving a conveyance motor 1709 for conveying the recording medium (rotating the platen roller 5000 shown in FIG. 12), and a motor driver 1707 for driving a carrier motor 1710 (corresponding to the drive motor 5013 of FIG. 12).

The controlling portion has a gate array (G.A.) 1704 for effecting the control of the supply of recording data to the recording head 1708 in response to the recording signal from the interface 1700, an MPU 1701, a ROM 1702 storing therein a control program the MPU 1701 executes, and DRAM 1703 preserving therein various data such as the aforementioned recording signal and the recording data supplied to the recording head. The gate array 1704 also effects the data forwarding control between the MPU 1701 and the DRAM 1703.

When the recording signal is inputted to the interface 1700, the recording signal is converted into recording data for recording between the gate array 1704 and the MPU 1701. Then, the conveyance motor 1709 and the carrier motor 1710 are driven by the respective motor drivers 1706 and 1707 and also, the recording head 1708 is driven in accordance with the recording data sent to the head driver 1705, whereby recording is effected. The driving electrical energization time of the aforedescribed heat generating resistance member is also controlled by the MPU 1701.

<Ink Jet Head>

Description will now be made of an example of the ink jet head suitably used in the present invention.

CONSTRUCTION EXAMPLE 1 OF THE INK JET HEAD

Figure 6:
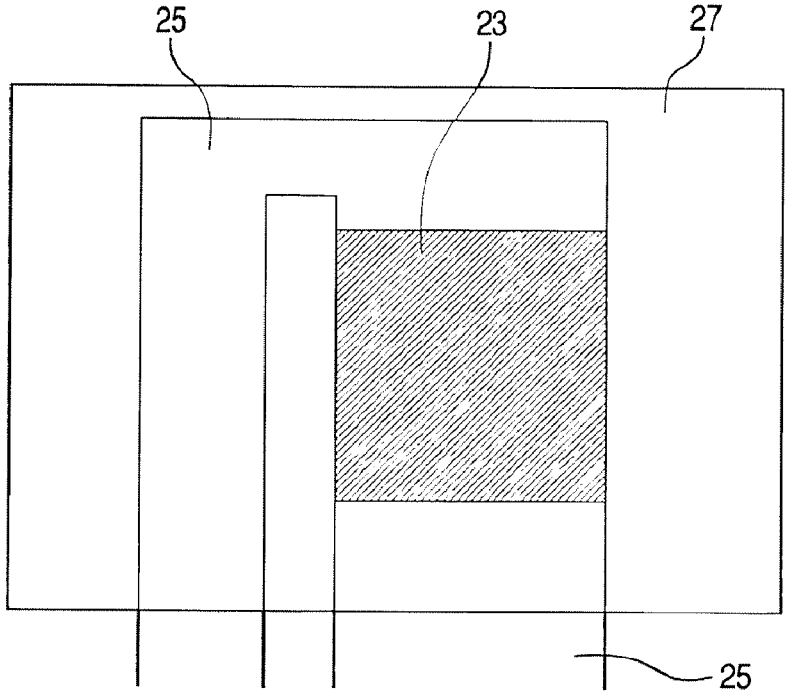
FIG. 6 is a plan view of a base showing one of heat generating resistors shown in FIG. 5 on an enlarged scale.

FIG. 5 is a plan view of the essential portions of construction example 1 of the ink jet head suitably used in the present invention as it is seen from the discharge port side. FIG. 6 is a plan view of a base member showing on an enlarged scale one of the heat generating resistance members shown in FIG. 5. In FIG. 5, a nozzle material 10 is shown in a seen-through state so that the internal structure can be seen.

The ink jet head 1 has the base member 20 formed with a plurality of heat generating resistance members 23, and the nozzle material 10 joined to the base member 20. The heat generating resistance members 23 are arranged in a row. In the case of an ink jet head for colors, however, they can also be arranged in a plurality of rows. In the nozzle material 10, discharge ports 11 are formed at locations opposed to the respective heat generating resistance members 23 with the centers thereof located on the centers of the heat generating resistance members 23. Further, the nozzle material 10 is formed with a nozzle wall 13 partitioning adjacent ones of the heat generating resistance members 23, and by the base member 20 and the nozzle material 10 being joined together, a flow path to which the discharge port 11 opens is formed for each heat generating resistance member 23.

In the base member 20, a supply port (not shown) is formed through the base member 20 in order to supply the ink from the outside of this ink jet head 1 onto each heat generating resistance member 23. The supply port opens to an ink chamber common to the flow paths. Also, a filter 29 which is a pillar-shaped structure is provided between the ink chamber and each flow path in order to block the entry of foreign substances into the ink jet head 1. Insulating film (not shown in FIG. 6) and anti-cavitation film 27 are provided so as to commonly cover all the heat generating resistance members 23 are arranged in a row. Further, as shown in FIG. 6, electrode wiring 25 is connected to the heat generating resistance members 23.

The ink is supplied from the supply port into the flow paths and flows onto the heat generating resistance members 23. In this state, the heat generating resistance members 23 are electrically energized through the electrode wiring 25 to thereby generate heat energy, whereby the ink on the heat generating resistance members 23 bubbles, whereby the ink is discharged from the discharge ports 11. The ink jet head 1 of this example is of the so-called side shooter type in which the heat generating resistance members 23 and the discharge ports 11 are opposed to each other. The discharging method of the ink jet head 1 of the side shooter type is roughly classified into a method of communicating a bubble produced by the driving of the heat generating resistance members 23 with the atmosphere, and a method of not communicating the bubble with the atmosphere. The present invention is applicable to both of these. In the latter discharging method, the produced bubble disappears without communicating with the atmosphere.

Figure 7:
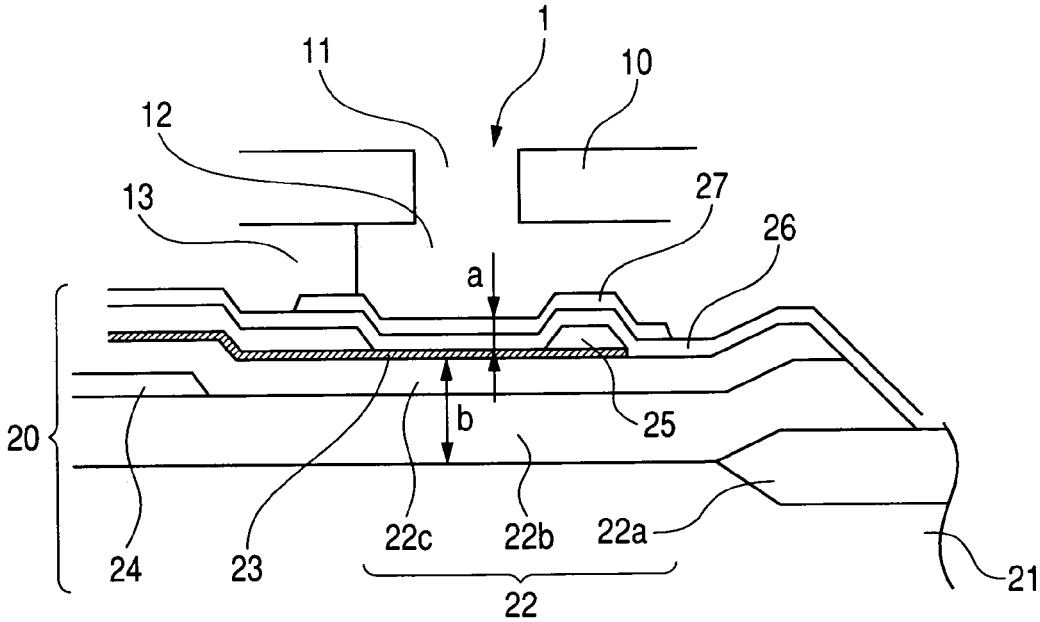
FIG. 7 is a front cross-sectional view of the ink jet head shown in FIG. 5 taken along line VII—VII.

FIG. 7 is a cross-sectional view of the ink jet head of FIG. 5 taken along the line VII—VII of FIG. 5. The ink jet head 1 of the present example will hereinafter be described with respect chiefly to the layer construction of the base member 20 with reference to FIG. 7.

The base member 20 has a substrate 21 formed of silicon, a heat accumulation layer 22 formed on the surface thereof and serving also as electrical insulating film, a heat generating resistance member 23 partly formed on the heat accumulation layer 22, electrode wires 24, 25 for supplying electric power to the heat generating resistance member 23, insulating film 26 formed so as to cover the heat generating resistance member 23 and the heat accumulation layer 22, and anti-cavitation film 27 formed on a portion of the insulating film 26. Protection film is constituted by the insulating film 26 and the anti-cavitation film 27. In the present example, the insulating film 26 is constituted by SiN film having a film thickness of 0.3 μm, and the anti-cavitation film 27 is constituted by Ta film having a film thickness of 0.23 μm. Accordingly, the layer thickness a of the protection film is 0.53 μm.

The heat accumulation layer 22 is of three-layer structure in which thermally oxidated film 22*a*, inter-layer film 22*b* and inter-layer film 22*c* are laminated in succession from the substrate 21 side. However, the thermally oxidated film 22*a* is partly formed so as not to exist in an area opposed to the heat generating resistance member 23, and in the present example, it is only two layers, i.e., the inter-layer film 22*b* and the inter-layer film 22*c* that substantially functions as the heat accumulation layer 22. The thermally oxidated film 22*a* is constituted by $SO_2$ film formed by the thermal oxidating method, and the inter-layer film 22*b* and the inter-layer film 22*c* are constituted by $SiO_2$ formed by the CVD method. Also, the film thickness of each of the inter-layer film 22*b* and the inter-layer film 22*c* is 0.7 μm, and the layer thickness b of the heat accumulation layer 22 beneath the heat generating resistance member 23 in the present example is 1.4 μm.

The heat generating resistance member 23 in the present example is constituted by TaSiN having a film thickness of 500 Å. Also, the electrode wires 24 and 25 are formed of AlCu.

The nozzle material 10 is joined onto the base member 20 and forms an ink chamber 12 constituting a portion of the flow path between the heat generating resistance member 23 and the discharge port 11.

What is important here is to make the ratio of the heat resistance of the heat accumulation layer 22 to the heat resistance of the protection film on and under the heat generating resistance member 23 proper, or to make the compositions and film thicknesses of the protection film and the heat accumulation layer 22 proper. In the construction of the conventional ink jet head shown in FIG. 14, the protection film is constituted by insulating film formed of SiN and having a film thickness of 0.3 μm, and anti-cavitation film formed of Ta and having a film thickness of 0.23 μm, and the heat accumulation layer is constituted by $SiO_2$ film having a film thickness of about 1 μm and inter-layer film comprising two layers of $SiO_2$ each having a film thickness of about 1 μm, and the total thickness thereof is 3 μm. Accordingly, the above-mentioned heat resistance ratio (the heat resistance of the heat accumulation layer/the heat resistance of the protection film)=8.56. In contrast, in the ink jet head of the present example, the protection film is the same as that in the prior art, but the heat accumulation layer 22 beneath the heat generating resistance member 23 is constituted by two layers of film of $SiO_2$ each having a film thickness of 0.7 μm and therefore, the above-mentioned heat resistance ratio=3.99.

Accordingly, in the ink jet head 1 of the present example, as previously described, durability can be particularly improved when the heat generating resistance members 23 are driven within the range of 0.5 μs to 2.0 μs of the driving electrical energization time thereof. Also, the inter-layer film 22*b*, 22*c* serves also as the insulation of other circuit such as the insulation of the electrode wires 24 and 25 and therefore, for the purpose of stable film forming, the thickness of each layer need be 0.7 μm or greater, and in the present example, each layer is formed with a minimum thickness, but the thickness of the whole of the heat accumulation layer 22 can also be 1.4 to 1.7 μm. The material of the film constituting the heat accumulation layer, the number of layers and structure of the heat accumulation layer 22 are arbitrarily changeable within such a range that the heat resistance value of the heat accumulation layer 22 is two times or greater and less than five times as great as the heat resistance value of the protection film. For example, at least one layer of the heat accumulation layer 22 can be $SiO_x$ film or borophosphosilicate glass (BPSG) film, and as a film forming method therefor, use can be made of any method such as the thermally oxidating method or the CVD method.

The anti-cavitation film 27 is constituted by a single layer of Ta film, but can also be of laminated structure of a plurality layers of thin film. Thereby, the covering property on a level difference portion produced on heat generating resistance members 23 by the electrode wire 25 can be improved. This also holds true when the insulating film 26 is of laminated structure of a plurality of layers of thin film. Also, the anti-cavitation film 27 can be formed by film of TaCr, Cr, Ir, Pt or Ir alloy, besides Ta. In a case where the anti-cavitation film 27 is of laminated structure of a plurality of layers of film, at least one layer thereof can also be formed of one of these materials.

While in the present example, the heat generating resistance member 23 is formed of TaSiN having a film thickness of 0.05 μm, this is not restrictive, but the heat generating resistance member 23 can also be formed of TaN and further, it has been found that if the material forming the heat generating resistance member 23 is a material having such a thickness of 0.01 to 0.1 m that the balance of the heat resistance of the protection film and the heat accumulation layer 22 on and under the heat generating resistance member 23 is not broken, there will arise no problem about durability and high frequency driving in which the driving electrical energization time is within a range of 0.5 μs to 2.0 μs.

In the present example, the plane size of the heat generating resistance member 23 is a square of 26 μm×26 μm. However, the size of the heat generating resistance member 23 is not restricted thereto, but it has been confirmed that up to at least 16 μm×16 μm to 39 μm×39 μm poses no problem. Also, the shape of the heat generating resistance member 23 is not restricted to a square, but can be a rectangle. Further, the number of heat generating resistance members 23 per discharge port 12 can be plural, and for example, there can be adopted a construction in which two rectangular members of 10 μm×24 μm are connected in series.

As described above, the heat resistance ratio of the heat accumulation layer 22 to the protection film on and under the heat generating resistance member 23 is made proper and moreover, such high frequency driving that the driving electrical energization time is within the range of 0.5 μs to 2.0 μs is effected, whereby irrespective of the discharging method being a method of communicating a bubble produced by the driving of the heat generating resistance member 23 with the atmosphere or a method of not communicating the bubble with the atmosphere, there can be obtained an effect not greatly differing but equally excellent in effectively preventing the deterioration of the protection film without reducing the heat transmission efficiency to the ink, and realizing the longer life of the heat generating resistance member and also, improving the radiation characteristic and realizing the driving at a higher frequency.

CONSTRUCTION EXAMPLE 2 OF THE INK JET HEAD

Figure 8:
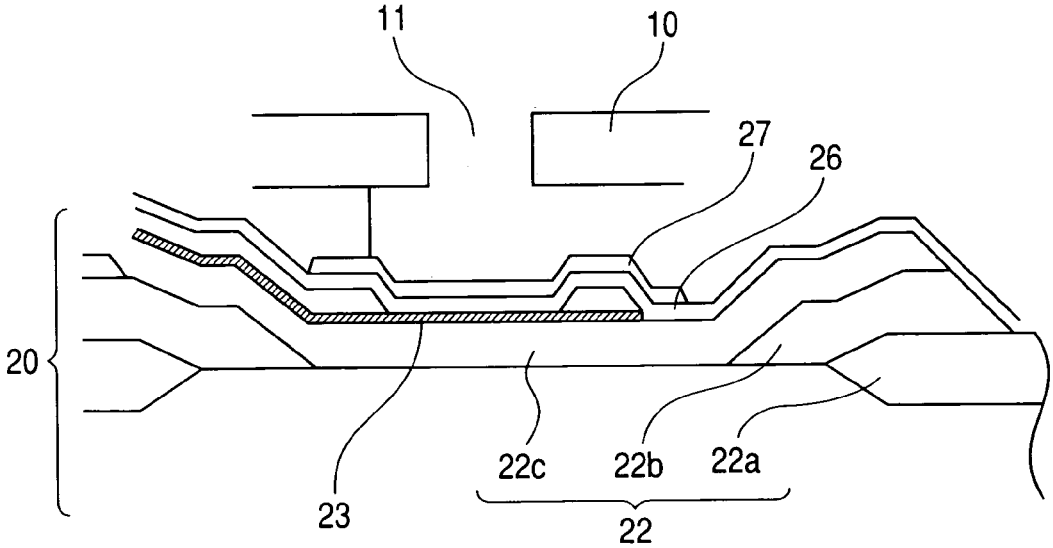
FIG. 8 is a cross-sectional view similar to FIG. 7 but showing construction example 2 of the ink jet head suitably used in the present invention.

FIG. 8 is a cross-sectional view similar to FIG. 7 but showing construction example 2 of the ink jet head suitably used in the present invention. In FIG. 8, constituents similar to those in FIG. 7 are given the same reference characters as those in FIG. 7.

The ink jet head of the present example differs from construction example 1 of the ink jet head in that the heat accumulation layer 22 is formed so that of the two layers of inter-layer film 22*b* and 22*c* constituting a portion of the heat accumulation layer 22, only the inter-layer film 22*b* may be partly formed like the thermally oxidated film 22*a*, and only the other inter-layer film 22*c* may exist beneath the heat generating resistance member 23. That is, in the present example, it is a single layer of inter-layer film 22*c* that substantially functions as the heat accumulation layer 22. In the other points, the construction of the present example is the same as that of construction example 1 of the ink jet head.

The film thickness of the inter-layer film 22*c* is 0.7 μm and accordingly, the thickness of the heat accumulation layer 22 beneath the heat generating resistance member 23 also is 0.7 μm. Also, the inter-layer film 22*c* is formed of $SO_2$ as in construction example 1 of the ink jet head, and the protection film on the heat generating resistance member 23, i.e., the insulating film 26 and the anti-cavitation film 27 are also formed of and with materials and film thicknesses similar to those in construction example 1 of the inkjet head and therefore, the heat resistance ratio of the heat accumulation layer 22 to the protection film in the present example is 2.00.

Thus, according to the ink jet head of the present example, when as previously described, the heat generating resistance member 23 is driven for a driving electrical energization time within the range of 0.5 μs to 2.0 μs, durability can be further improved as compared with construction example 1 of the ink jet head. In order not to reduce the heat transmission efficiency to the ink, it is preferable that the driving electrical energization time be 0.5 μs to 1.2 μs. Also, the thickness of the inter-layer film 22*c*, i.e., the heat accumulation layer 22, can be changed within a range of 0.7 to 1.4 μm.

CONSTRUCTION EXAMPLE 3 OF THE INK JET HEAD

Figure 9:
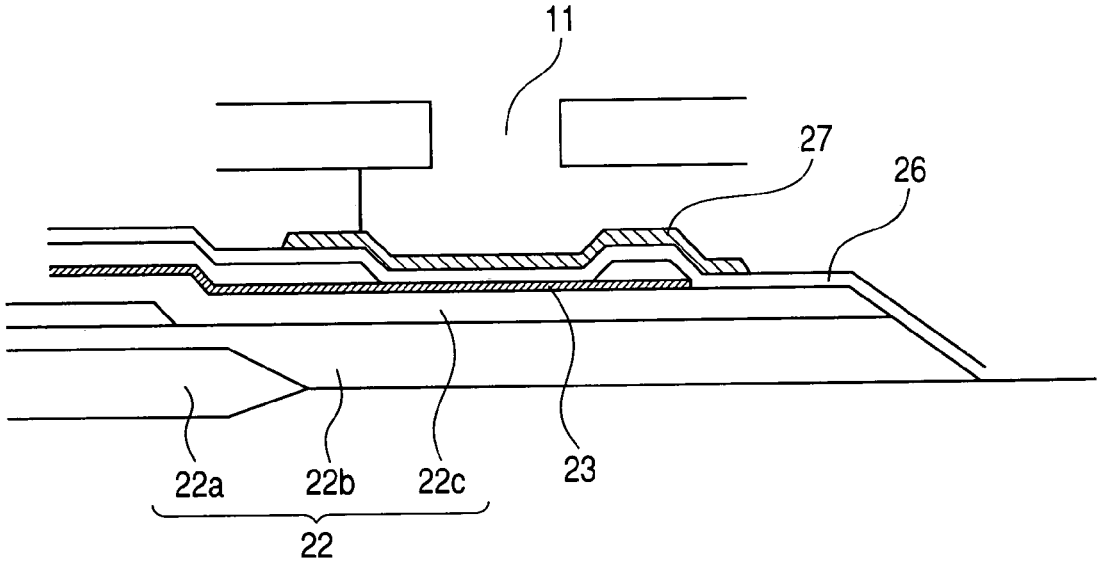
FIG. 9 is a cross-sectional view similar to FIG. 7 but showing construction example 3 of the ink jet head suitably used in the present invention.

FIG. 9 is a cross-sectional view similar to FIG. 7 but showing construction example 3 of the ink jet head suitably used in the present invention, and in FIG. 9, constituents similar to those in FIG. 7 are given the same reference characters as those in FIG. 7.

The ink jet head of the present example differs from construction example 1 of the ink jet head in that in the heat accumulation layer 22, the thermally oxidated film 22*a* is not formed in a region corresponding to the flow path. The materials, film thicknesses and other constructions of the anti-cavitation film 27, the insulating film 26 and the inter-layer film 22*b*, 22*c* are the same as those in construction example 1 of the ink jet head.

The thermally oxidated film 22*a* is difficult to form by a thin pattern, as compared with the inter-layer film 22*b*, 22*c* which can be formed by etching and therefore, if the thermally oxidated film 22*a* is left in the region corresponding to the flow path, the flow path tends to become long. According to the present example, the thermally oxidated film 22*a* is absent in the region corresponding to the flow path and therefore, as compared with construction example 1 of the ink jet head, the flow path can be shortened. As a result, an ink chamber (not shown) leading to the shortened flow path can be brought close to the heat generating resistance member 23, and the supply of the ink from the ink chamber onto the heat generating resistance member 23 can be effected efficiently. Accordingly, according to the present example, in addition to an effect similar to that of construction example 1 of the ink jet head, the degree of freedom of design such as coping with high frequency driving can be further improved. From this point of view, the thermally oxidated film 22*a* need not always be provided in the present example.

CONSTRUCTION EXAMPLE 4 OF THE INK JET HEAD

Figure 10:
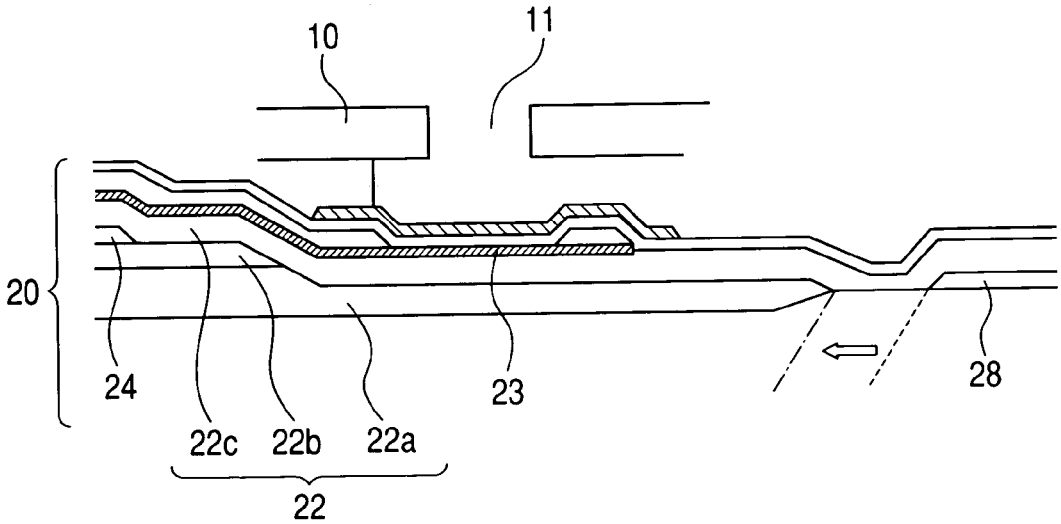
FIG. 10 is a cross-sectional view similar to FIG. 7 but showing construction example 4 of the ink jet head suitably used in the present invention.

FIG. 10 is a cross-sectional view similar to FIG. 7 but showing construction example 4 of the ink jet head suitably used in the present invention, and in FIG. 10, constituents similar to those in FIG. 7 are given the same reference characters as those in FIG. 7.

The ink jet head of the present example also differs in the structure of the heat accumulation layer 22 from the above-described examples, and specifically, in a portion corresponding to the heat generating portion, the inter-layer film 22*b* adjacent to the thermally oxidated film 22*a* is removed by etching and also, the thermally oxidated film 22*a* has its film thickness made small by half-etching. In the present example, it is the inter-layer film 22*c* and the left portion of the thermally oxidated film 22*a* that substantially functions as the heat accumulation layer 22, and the total thickness of the heat accumulation layer 22 can be considered to be the sum of the film thickness of the inter-layer film 22*a* and the film thickness of the remaining portion of the thermally oxidated film 22*a*. The present example is a construction effective to make the total thickness of the heat accumulation layer 22 while keeping the film thickness of the inter-layer film 22*c* relatively great. By making the inter-layer film 22*c* thick, it is possible to make the thickness of the electrode wire 24 beneath the inter-layer film 22*c* great, and decrease the wiring resistance of the electrode wire 24.

Also, leaving the thermally oxidated film 22*a* by half-etching brings a good effect to the formation of the ink chamber (not shown) leading to the flow path. In order to supply the ink to the flow path, usually a through-hole is formed in the base member 20 formed of silicon from a surface opposite to the surface of the base member 20 to which the nozzle member 10 is joined, and a portion in which this through-hole opens is used as a supply port (see FIG. 5). For the formation of the through-hole, a method by the anisotropic etching of mono-crystalline silicon is excellent in respect of dimensional accuracy. For example, in a case where <100> substrate is used as a silicon substrate which provides the base of the base member 20, an ink chamber of a square cone having (111) surface as a wall surface is obtained by anisotropic etching. The (111) surface is inclined by about 54° with respect to the surface of the substrate, and assumes a cross-section indicated by dotted line in FIG. 10.

Now, a crystal defect or the like may rarely exist in a silicon substrate. If also in the formation of a through-hole by anisotropic etching, a crystal defect or the like exists, etching will preferentially progress only in that portion and dimensional abnormality will occur to a portion of the ink chamber. In order to solve this problem, it is desirable that as shown in FIG. 10, a sacrifice layer 28 higher in etching speed than-mono-crystalline silicon be formed in a region wherein the through-hole of the base member 20 after the inter-layer film 22*b* has been removed is formed. The sacrifice layer 28 is used as an etching stop layer because when unevenness has occurred to the etching time in the manufacturing process, or when the unevenness of the etching speed of a polycrystalline silicon layer has occurred, the through-hole causes unevenness to the design value. As long as the above-mentioned unevenness does not greatly occur, the sacrifice layer may be dispensed with, but the details of the sacrifice layer will be described below. The sacrifice layer 28 is removed by the formation of the through-hole. Polycrystalline silicon or aluminum is suitable as the sacrifice layer 28. When aluminum is used, the sacrifice layer 28 can be formed simultaneously with the electrode wire 24 and therefore, there is no increase in the number of steps due to the sacrifice layer 28 being formed, and this is also advantageous in suppressing the rise of the manufacturing cost.

However, aluminum is high in etching speed as compared with polycrystalline silicon and therefore, in a case where when forming the through-hole, the etching time is set a little long with the unevenness of the thickness of the silicon substrate taken into account, the through-hole tends to become larger than the design value by overetching. If at this time, as shown in FIG. 10, the thermally oxidated film 22*a* is present near the sacrifice layer 28, silicon oxide works as an etching stop layer because it is insoluble in etching liquid (e.g. TMAH: tetramethyl ammonium hydroxide), and as indicated by dot-and-dash line in FIG. 10, the enlargement of the through-hole is limited to a position contacting with the end of the thermally oxidated film 22*a*. Even in the case of the same film constituting the heat accumulation layer 22, such BPSG film as is used in the inter-layer film 22*b*, 22*c* or film by plasma CVD is not fine and is dissolved in the etching liquid and therefore, is not suitable as the etching stop layer.

As described above, the thermally oxidated film 22*a* can be utilized as the etching stop layer when the through-hole is formed by anisotropic etching and therefore, if the thermally oxidated film 22*a* is formed so as to surround the area in which the through-hole is formed, the sacrifice layer 28 need not always be provided.

As described above in construction examples 1 to 4, various combinations are conceivable as the film constructions below and near the heat generating resistance member 23, but to achieve the object of the present invention, the heat resistance below the heat generating resistance member 23 can be within a predetermined range relative to the heat resistance above the heat generating resistance member 23, and the respective film thicknesses may be determined by other requirements. For example, to secure insulativeness, the film thicknesses had better be great, but to secure conduction between the layers by a contact hole, it is better to make the film thickness of the inter-layer film to thereby prevent the opening in the level difference portion of the upper layer electrode.

Figure 11:
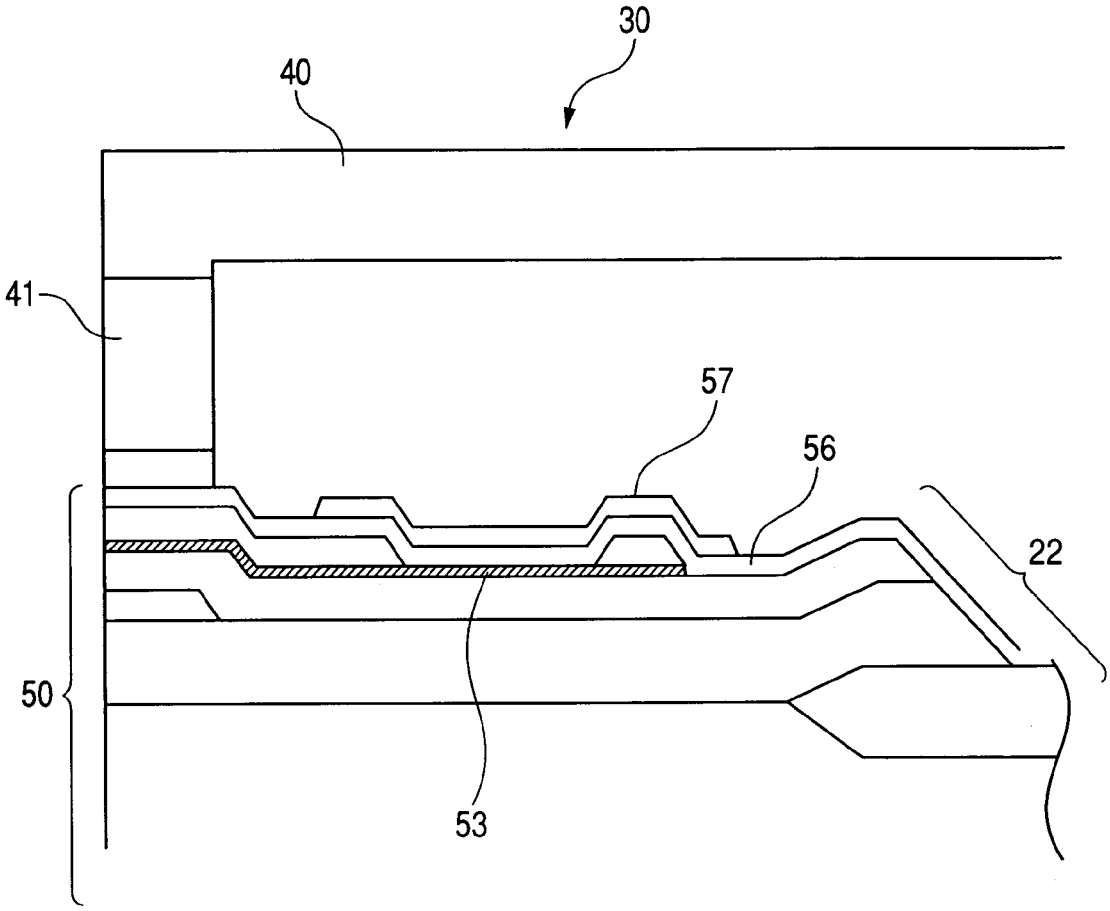
FIG. 11 is a cross-sectional view of an example of an ink jet head of an edge shooter type to which the present invention is applied.

Also, while in each of the above-described examples, description has been made of the ink jet head of the so-called side shooter type in which the discharge ports 12 are formed at locations opposed to the heat generating resistance members 23 as an example, the present invention is not restricted thereto, but can also be applied to an ink jet head 30 of a so-called edge shooter type as shown in FIG. 11.

The ink jet head 30 of the edge shooter type, like the ink jet head of the side shooter type, has a base member 50 and a nozzle material 40 joined thereto, but the structure of the nozzle material 40 differs from that of the ink jet head of the side shooter type. Specifically, a discharge port 41 is formed not at a location opposed to a heat generating resistance member 53, but on the end surface of the nozzle material 40, and the ink is discharged in a direction substantially parallel to the upper surface of the base member 50.

Again in such an ink jet head 30 of the edge shooter type, the above-described construction of the present invention is applied to the constructions of protection film and a heat accumulation layer 52 in the base member 50, whereby there is obtained an effect similar to that of the ink jet head of the side shooter type.

As described above, in a case where the ink jet head is driven at a driving pulse width of 2.0 μs or less, the heat resistance of the heat accumulation layer below the heat generating resistance member is set to a range of two times or greater and less than five times as great as the heat resistance of the protection film above the heat generating resistance member, the occurrence of "scorching" by the heat on the heat generating resistance member can be suppressed without the heat transmission efficiency to the ink being reduced and also, the deterioration of the protection film can be prevented to thereby realize the longer life of the heat generating resistance member. Also, the radiation characteristic can be improved by the prevention of reboiling and heat accumulation, and driving at a higher frequency can be realized.

Also, even if the size of an ink droplet discharged is made small, it becomes possible to improve the durability of the ink jet head by several times to about ten times as compared with the prior art, by adopting the construction of the present invention, and there is also obtained the effect that recording at a super-high quality of image can be realized. By improving the durability, it is possible to reduce the running cost as viewed from a long-term point of view. Further, by the durability being improved, it is unnecessary to increase the number of the heat generating resistance members or arrange the heat generating resistance members indiscriminately at high density even if the size of the ink droplet discharged is made small, and this leads to a general reduction in cost, including the simplification of the manufacturing process of the ink jet head and the driving circuit, etc. of the ink jet head. Also, there is the effect that even if there is a constant tolerance in the thickness of the heat accumulation layer, the heat transmission efficiency to the ink is not reduced and therefore, the manufacturing tolerance margin of the ink jet head is increased and also, the yield is improved and the degree of freedom of design is also improved.

This application claims priority from Japanese Patent Application No. 2003-434520 filed Dec. 26, 2003, which is hereby incorporated by reference herein.

What is claimed is:

1. An ink jet head having a base member in which a heat accumulation layer, a heat generating member generating heat energy used to discharge ink, and a protection film for protecting said heat generating member are formed in succession on a substrate, and having a discharge port for discharging the ink therethrough provided correspondingly to said heat generating member, wherein a heat resistance value of a portion of said heat accumulation layer which is under said heat generating member is two times or greater than and less than five times as great as a heat resistance value of a portion of said protection film which is on said heat generating member, wherein said heat accumulation layer comprises a plurality of layers of thin film, and wherein said heat accumulation layer does not include a thermally oxidated film in a region corresponding to a flow path communicating with said discharge port.

2. A driving method for an ink jet head for driving, by use of an ink jet head having a base member in which a heat accumulation layer, a heat generating member generating heat energy used to discharge ink, and a protection film for protecting said heat generating member are formed in succession on a substrate, and having a discharge port for discharging the ink therethrough provided correspondingly to said heat generating member, wherein a heat resistance value of a portion of said heat accumulation layer which is under said heat generating member is two times or greater than and less than five times as great as the a heat resistance value of a portion of said protection film which is on said heat generating member, said method comprising:

driving said heat generating member for a driving electrical energization time of 0.5 μs or greater and 2.0 μs or less to thereby discharge the ink from said discharge port.

3. A driving method according to claim 2, wherein said driving electrical energization time is 0.5 μs or greater and 1.2 μs or less.

4. A driving method according to claim 3, wherein said protection film has a laminated structure including at least an SiN film having a film thickness of 0.3 μm, and a Ta film having a film thickness of 0.23 μm, and said heat accumulation layer has a total thickness of 0.7 μm or greater and 1.7 μm or less and includes at least one layer of Si oxide film.

5. A driving method according to claim 2, wherein the driving of said heat generating member for discharging the ink is driving by the application of a plurality of pulses, and said driving electrical energization time is the total electrical energization time of said plurality of pulses.

6. An ink jet recording apparatus provided with:

an ink jet head having a base member in which a heat accumulation layer, a heat generating member generating heat energy used to discharge ink, and a protection film for protecting said heat generating member are formed in succession on a substrate, and having a discharge port for discharging the ink therethrough provided correspondingly to said heat generating member, wherein the a heat resistance value of a portion of said heat accumulation layer which is under said heat generating member is two times or greater than and less than five times as great as a heat resistance value of a portion of said protection film which is on said heat generating member; and driving means for driving said heat generating member for a driving electrical energization time of 0.5 μs or greater and 2.0 μs or less.

* * * * *

UNITED STATES PATENT AND TRADEMARK OFFICE

CERTIFICATE OF CORRECTION

PATENT NO. : 7,216,961 B2
APPLICATION NO. : 11/012186
DATED : May 15, 2007
INVENTOR(S) : Oikawa et al.

It is certified that error appears in the above-identified patent and that said Letters Patent is hereby corrected as shown below:

COLUMN 2:
Line 39, “ink jet” should read --an ink jet--.
Line 41, “protection,” should read --protection--.

COLUMN 5:
Line 26, “differs” should read --differs,--.

COLUMN 13:
Line 6, “other circuit” should read --other circuits--.
Line 25, “plurality layers” should read --plurality of layers--.
Line 41, “0.1 m” should read --0.1 μm--.

COLUMN 14:
Line 32, “formed of $SO_2$” should read --formed of $SiO_2$--.
Line 37, “inkjet” should read --ink jet--.

COLUMN 16:
Line 8, “than-mono-crystalline” should read --than mono-crystalline--.

COLUMN 18:
Line 24, “as the a” should read --as a--.
Line 53, “wherein the a” should read --wherein a--.

Signed and Sealed this

Third Day of March, 2009

John Doll

JOHN DOLL
*Acting Director of the United States Patent and Trademark Office*